US007542048B2

(12) United States Patent
Kim et al.

(10) Patent No.: US 7,542,048 B2
(45) **Date of Patent: *Jun. 2, 2009**

(54) APPARATUS AND METHOD FOR CONVERTING METADATA COLOR TEMPERATURE AND APPARATUS AND METHOD FOR PROVIDING METADATA

(75) Inventors: Sang-kyun Kim, Kyungi-do (KR); Du-sik Park, Kyungi-do (KR); Chang-yeong Kim, Kyungi-do (KR); Ki-won Yoo, Seoul (KR); Young-sik Huh, Kyungki-do (KR)

(73) Assignee: Samsung Electronics Co., Ltd., Suwon, Kyungki-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/984,042

(22) Filed: Nov. 13, 2007

(65) Prior Publication Data

US 2008/0062191 A1 Mar. 13, 2008

Related U.S. Application Data

(63) Continuation of application No. 10/341,510, filed on Jan. 14, 2003, now Pat. No. 7,295,213.

(30) Foreign Application Priority Data

May 10, 2002 (KR) ..... 2002-25910

(51) Int. Cl.
*G09G 5/02* (2006.01)

(52) U.S. Cl. ..... 345/589; 345/581; 345/591; 345/600; 348/655

(58) Field of Classification Search ..... None
See application file for complete search history.

(56) References Cited

U.S. PATENT DOCUMENTS 5,262,848 A 11/1993 Kim
5,481,302 A 1/1996 Yamamoto et al.

(Continued)

FOREIGN PATENT DOCUMENTS

EP 1 276 057 A2 1/2003

(Continued)

OTHER PUBLICATIONS

"Working with raw image files in Adope Photoshop," http://www.adobe.com/products/photoshop/pdfs/ps_cameraraw_userguide.pdf.

(Continued)

*Primary Examiner*—Antonio A Caschera
(74) *Attorney, Agent, or Firm*—Buchanan Ingersoll & Rooney PC

(57) ABSTRACT

An apparatus for providing image metadata includes an input unit, an image metadata decoding unit, and an image color temperature converting unit. The input unit receives an input image, metadata corresponding to the color temperature of the input image, and color temperature information preferred by a user. The image metadata decoding unit calculates a color temperature corresponding to the metadata. The image color temperature converting unit converts the color temperature of the input image using the color temperature calculated by the image metadata decoding unit and the color temperature information preferred by a user.

10 Claims, 1 Drawing Sheet

U.S. PATENT DOCUMENTS

| | | | | |
|---|---|---|---|---|
| 5,541,649 | A | 7/1996 | Yamamoto et al. | |
| 5,874,955 | A | 2/1999 | Rogowitz et al. | |
| 6,249,601 | B1 | 6/2001 | Kim et al. | |
| 6,629,104 | B1 | 9/2003 | Parulski et al. | |
| 6,757,684 | B2 | 6/2004 | Svendsen et al. | |
| 6,833,865 | B1 | 12/2004 | Fuller et al. | |
| 7,239,315 | B2 * | 7/2007 | Kim et al. | 345/426 |
| 7,295,213 | B2 * | 11/2007 | Kim et al. | 345/589 |
| 2001/0030694 | A1 | 10/2001 | Abe | |
| 2001/0040588 | A1 | 11/2001 | Shiraiwa et al. | |
| 2004/0027624 | A1 | 2/2004 | Parulski et al. | |
| 2005/0050043 | A1 | 3/2005 | Pyhalammi et al. | |

FOREIGN PATENT DOCUMENTS

| | | | |
|---|---|---|---|
| EP | 1 276 057 | A3 | 10/2004 |
| JP | 10-031479 | | 2/1998 |
| JP | 10224643 | | 8/1998 |
| JP | 10-340336 | | 12/1998 |
| JP | 2000-171304 | | 6/2000 |
| JP | 2001-90009 | | 4/2001 |
| KR | 1998-0078328 | | 4/1997 |
| KR | 1998-0079137 | | 11/1998 |
| WO | WO 96/01467 | | 1/1996 |

OTHER PUBLICATIONS

"Adobe Photoshop for Windows—Downloads," http://www.adobe.com/support/downloads/product.jsp?product=39 &plateform=Windows.

Digital Imaging Group, Inc., "DIG35 Specification -Metadata for Digital Images," Version 1.0, Aug. 30, 200, pp. 26-43.

"Digging into Adobe Camera Raw—Tutorial," http://studio.adobe.com/us/tips/tip.jsp?p=1&id=650&xml=phs8ppraw.

NISO Standards Committee, "NISO Draft Standard, Data Dictionary—Technical Metadata for Digital Still Images," Working Draft 1.0, Jul. 5, 2000.

http://en.wikipedia.org/wiki/Color_temperature.

European Search Report issued by the European Patent Office on Dec. 3, 2004 in corresponding application.

J. M. Corridoni et al., "Image Query by Semantical Color Content," Proceedings of the Workshop on Advanced Visual Interfaces AVI, May 27, 1996, pp. 213-222.

A. Del Bimbo, "A Perspective View on Visual Information Retrieval Systems," Content-Based Access of Image and Video Libraries, 1998, Proceedings, IEEE Workshop on Santa Barbara, CA, Jun. 21, 1998, pp. 108-109.

"Working with raw image files in Adope Photoshop," http://www.adobe.com/products/photoshop/pdfs/ps_cameraraw_userguide.pdf, Apr. 3, 2003.

"Adobe Photoshop for Windows—Downloads," http://www.adobe.com/support/downloads/product.jsp?product=39 &plateform=Windows, Oct. 4, 2001.

"Digging into Adobe Camera Raw—Tutorial," http://studio.adobe.com/us/tips/tip.jsp?p=1&id=650&xml=phs8ppraw, Mar. 22, 2004.

http://en.wikipedia.org/wiki/Color_temperature, Jan. 13, 2004.

* cited by examiner

APPARATUS AND METHOD FOR CONVERTING METADATA COLOR TEMPERATURE AND APPARATUS AND METHOD FOR PROVIDING METADATA

BACKGROUND OF THE INVENTION

This application claims the priority of Korean Patent Application No. 2002-25910, filed May 10, 2002, in the Korean Intellectual Property Office, the disclosure of which is incorporated herein in its entirety by reference.

1. Field of the Invention

The present invention relates to a method and an apparatus for controlling the color temperature of displayed images according to a user's preference, and more particularly, to a method and an apparatus for controlling display preference by using color temperature metadata.

2. Description of the Related Art

In conventional techniques, the color temperature of output images provided to a user, i.e., a customer of image contents, has been adjusted by calculating the color temperature of the corresponding images in a user terminal.

However, according to such conventional techniques, it is difficult to reduce the cost of manufacturing user terminals since such user terminals must be manufactured to be able to compute the color temperatures of images. In addition, it is difficult to store the color temperatures of images, which are already computed, in a database as metadata and to re-use the metadata.

SUMMARY OF THE INVENTION

The present invention provides an apparatus and a method for providing metadata corresponding to the color temperatures of an input image.

The present invention also provides an apparatus and a method for converting such metadata into predetermined color temperatures.

According to an aspect of the present invention, there is provided an apparatus for providing image metadata. The apparatus includes a color temperature calculating unit which receives a predetermined image signal and derives color temperature information from the image signal, a metadata generating unit which receives the color temperature information, converts the color temperature information into metadata, and stores the metadata in a database, and an image metadata transmitting unit which transmits the metadata as well as the image signal to a user terminal over a communication network in response to the request of the user terminal.

According to another aspect of the present invention, there is provided an apparatus for converting a metadata color temperature. The apparatus includes an input unit which receives an input image, metadata corresponding to the color temperature of the input image, and color temperature information preferred by a user, an image metadata decoding unit which calculates a color temperature corresponding to the metadata, and an image color temperature converting unit which converts the color temperature of the input image using the color temperature calculated by the image metadata decoding unit and the color temperature information preferred by a user.

Preferably, the apparatus further includes an image display unit which outputs the input image, the color temperature of which is converted, and then provides the input image to a user.

Preferably, the image metadata decoding unit calculates the color temperature of an image coded as metadata and decodes the metadata following the way the image is coded.

Preferably, the image metadata decoding unit includes a predetermined look-up table, in which representative color temperatures of color temperature ranges, which the color temperature belongs to, and their corresponding metadata are recorded, and finds a color temperature value corresponding to certain metadata by searching the metadata in the look-up table.

According to still another aspect of the present invention, there is provided a method for providing image metadata. The method includes receiving a predetermined image signal and finding color temperature information from the image signal, receiving the color temperature information, converting the color temperature information into metadata, and storing the metadata in a database, and transmitting the metadata as well as the image signal to a user terminal over a communication network in response to the request of the user terminal.

According to still another aspect of the present invention, there is provided a method for converting the color temperature of metadata. The method includes receiving a predetermined input image, metadata corresponding to the color temperature of the input image, and color temperature information preferred by a user, calculating the color temperature corresponding to the metadata, and converting the color temperature of the input image using the color temperature calculated based on the metadata and the color temperature information preferred by a user.

Preferably, the method further includes outputting the input image, the color temperature of which is converted, and providing the input image to a user.

BRIEF DESCRIPTION OF THE DRAWINGS

The above features and advantages of the present invention will become more apparent by describing in detail exemplary embodiments thereof with reference to the attached drawing in which.

DETAILED DESCRIPTION OF THE INVENTION

Figure 1:
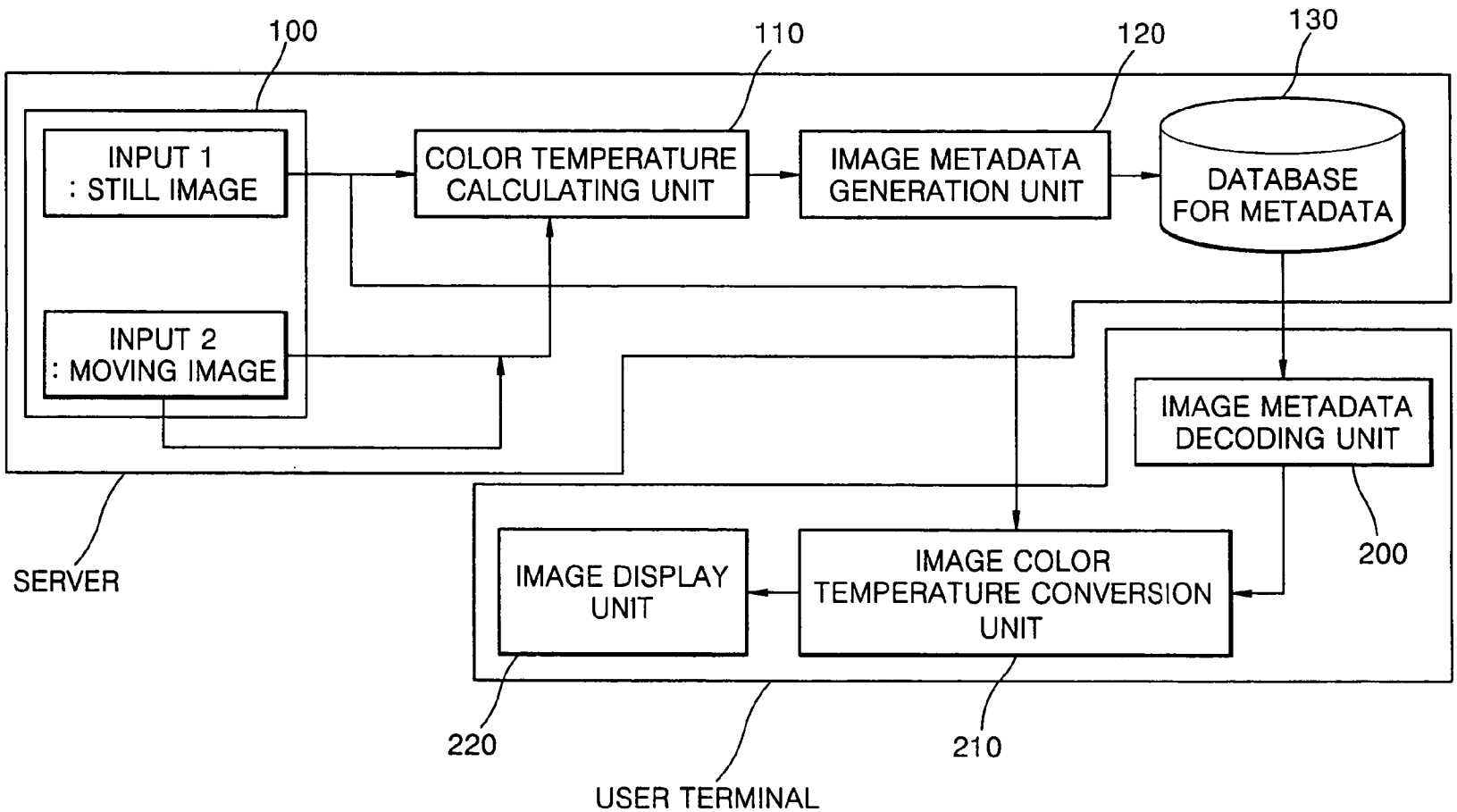
FIG. 1 is a diagram of an apparatus for controlling the display of images according to a user's preference by using color temperature metadata according to the present invention.

Hereinafter, the present invention will be described in greater detail with reference to the accompanying drawing.

FIG. 1 is a diagram of an apparatus for controlling the display of images by using color temperature metadata according to the present invention. Referring to FIG. 1, input images of an image input unit 100 include still images input from an image database and a bunch of still images constituting a moving image. Such still images may refer to representative images of the moving image.

A color temperature calculating unit 110 converts images input from the image input unit into a CIE XYZ color space and approximates the chromaticity coordinates (x, y) of a light source. Next, the color temperature calculating unit 110 converts the chromaticity coordinates (x, y) into correlated color temperatures which will act as descriptors representing images. The method of deriving chromaticity coordinates is disclosed in Japanese Patent No. 10-118862, and Korean Patent Nos. 237284 and 230446.

An image metadata generation unit 120 converts the color temperatures of the input images into metadata. Here, the metadata refers to a simple method of representing images. In other words, metadata corresponding to the input images stored in a database is transmitted to a user. For example, a color temperature of 1,667 K-25,000 K can be represented by 15 bits.

Alternatively, metadata can be generated by the following method. Input images can be sorted according to what a viewer feels about each of the input images, namely, according to the degree to which each of the input images looks warm, by using color temperatures. In other words, the input images can be classified as hot images, warm images, moderate images, or cool images by mapping the degree to which each of the input images looks warm in a certain range of color temperatures. For example, hot images can be mapped in a color temperature range of below 2,250 K, warm images can be mapped in a color temperature range of 2,251 K-4,170 K, moderate images can be mapped in a color temperature range of 4,171 K-8,060 K, and cool images can be mapped in a color temperature range of over 8,060 K. Each of the four image groups can be represented by 2 bits as metadata. For example, hot images, warm images, moderate images, and cool images can be represented by 00, 01, 10, and 11, respectively. The four color temperature ranges are converted into reciprocal color temperature ranges, and the reciprocal color temperature ranges are divided into several equal sub-ranges by quantization. Reciprocal color temperature (RC) can be derived from the following equation using color temperature: $RC=10^6/C$. The reason such a reciprocal color temperature scale is used is that the difference between images in terms of reciprocal color temperature is the same as the difference between the images sensed by human eyes.

After converting the color temperature ranges into the reciprocal color temperature ranges, the reciprocal color temperature ranges are divided by N so that they can be represented by Upper(In(N)) bits. Here, Upper(X) indicates a minimum natural number greater than X. For example, Upper (2.1)=3. In a case where M reciprocal color temperature ranges are divided by N, they can be represented by Upper (In(M))+Upper(In(N)) bits. For example, in a case where there are four color temperature ranges and they are divided by 64, i.e., in a case where M=4 and N=64, the color temperature ranges can be represented by 8 bits because Upper (In(4))+Upper(In(64))=2+6=8.

The database for image metadata is a set of color temperature metadata of still images or a bunch of images constituting a moving image, i.e., representative images of the moving image.

An image metadata decoding unit 200 decodes transmitted image metadata and thus computes the color temperature value of an input image. The method of decoding metadata varies depending on the type of metadata. If metadata represents the color temperature of an input image itself, for example, if a color temperature of 1,667 K-25,000 K is represented by 15 bits, only a process of converting coded binary numbers into decimal numbers is needed. On the other hand, if the color temperature of an input image, which is computed by the color temperature calculating unit 110, is quantized through the metadata generator, the color temperature metadata input into the image metadata decoding unit 200 must be converted into a predetermined color temperature range, and a color temperature representing the predetermined color temperature range must be derived. For example, a color temperature representing a certain color temperature range can be the average of color temperature values in the color temperature range.

A binary number, like 00000001, which is quantized into 8 bits through the color temperature metadata generator, is converted into a corresponding color temperature range, and the representative color temperature of the color temperature range is extracted. This method will be described in detail in the following.

(1) The first two bits of an 8-bit binary number are decoded in order to figure out which color temperature range corresponds to the 8-bit binary number. (For example, 00: hot→[1,667K, 2,250K], $T_{lb}$=1,667, $T_{ub}$=2,250)

(2) The maximum and minimum values in the corresponding color temperature range are converted into a reciprocal megakelvin scale. $RT_{lb}$=106/Tlb and $RT_{ub}$=106/2,250=444.444)

(3) The corresponding color temperature range [599.88, 444.444] is equally quantized into 64 sub-ranges.

(4) The remaining six bits (for example, 000001 in 00000001→$2^{nd}$ sub-range) of the 8-bit binary number are decoded and their corresponding color temperature range (for example, [597.0149, 595.0227]) is figured out, thus calculating an average color temperature ((597.0149+595.0227)÷2=596.0188). Next, the average color temperature is determined as a representative color temperature of the corresponding color temperature range and a color temperature corresponding to the 8-bits. (For example, $10^6$/596.0188=1,678 K)

Alternatively, a table of color temperatures corresponding to metadata is formed in advance following the above mentioned processes (1) through (4). The image metadata decoding unit 200 can be constituted so that a color temperature corresponding to certain 8-bit metadata can be found in the table by using the metadata as an address like in a look-up table method. In this case, even though a space where such table data need to be stored, is necessary, it is possible to extract a representative color temperature fast without using hardware for computation.

An image color temperature conversion unit 210 calculates a target color temperature based on an input image, the color temperature of the input image, and a color temperature preferred by a user. Next, the image color temperature conversion unit 210 modifies the input image using the target color temperature and the color temperature preferred by the user.

An image display unit 220 displays the modified image to the user.

The above-mentioned embodiments of the present invention can be written as programs that can be performed in a computer and can be realized in a commonly-used digital computer which operates such programs using a computer-readable recording medium.

The computer-readable recording medium includes a magnetic storage, such as a ROM, a floppy disk, or a hard disk, an optically readable medium, such as a CD-ROM or a DVD.

According to the present invention, it is possible for a contents provider to perform a process of calculating a color temperature, which conventionally takes much effort and time, during preparing contents and to transmit a small amount of metadata with contents, i.e., image data. In addition, a contents client does not need to additionally calculate a color temperature, thus reducing the cost of manufacturing a display for the contents client. Accordingly, a user can adjust images using a portable terminal, even though the portable terminal is generally less effective than a TV set or a personal computer in terms of calculation. In addition, according to the present invention, it is possible to re-use the color temperatures of images, which are already computed, by storing them in a database for metadata 130. Accordingly, it is possible to more effectively display images on a user's terminal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for providing image metadata, comprising:

a color temperature calculating unit in a computer, which receives an image signal and obtains a color temperature from the image signal; and a metadata generating unit, which obtains a color temperature range and a section where the color temperature of the image signal belongs among a plurality of color temperature ranges and a plurality of sections in each color temperature range, generates the obtained color temperature range and section into metadata, and stores the metadata, wherein the metadata comprises a first plurality of bits and a second plurality of bits, the first plurality of bits regarding the color temperature range where the color temperature of the image signal belongs, and the second plurality of bits regarding the section where the color temperature of the image signal belongs in the color temperature range.

2. The apparatus of claim 1 further comprising:

an image metadata transmitting unit which transmits the metadata as well as the image signal to a user terminal over a communication network in response to a request of the user terminal.

3. The apparatus of claim 1, wherein the metadata generating unit stores the metadata in relation to its corresponding image in a database.

4. The apparatus of claim 1, wherein the first plurality of bits is 2 bits and the second plurality of bits is 6 bits.

5. A method for providing image metadata, comprising:

receiving in a computer an image signal and obtaining a color temperature from the image signal; and obtaining in a computer a color temperature range and a section where the color temperature of the image signal belongs among a plurality of color temperature ranges and a plurality of sections in each color temperature range, generating the obtained color temperature range and section into metadata, and storing the metadata, wherein the metadata comprises a first plurality of bits and a second plurality of bits, the first plurality of bits regarding the color temperature range where the color temperature of the image signal belongs, and the second plurality of bits regarding the section where the color temperature of the image signal belongs in the color temperature range.

6. The method of claim 5 further comprising:

transmitting the metadata as well as the image signal to a user terminal over a communication network in response to a request of the user terminal.

7. The method of claim 5, wherein the metadata is stored in relation to its corresponding image in a database.

8. The method of claim 5, wherein the first plurality of bits is 2 bits and the second plurality of bits is 6 bits.

9. A method of generating metadata of an image, comprising:

in a computer dividing color temperature sections into four perceptual color temperature browsing modes based upon how people feel about images temperature-wise, and generating 2 bits of metadata corresponding to the perceptual color temperature browsing mode to which the color temperature of an image belongs;

in a computer dividing each of the four perceptual color temperature browsing modes into 64 color temperature sub-sections, and generating 6 bits of metadata corresponding to the color temperature sub-section to which the color temperature of an image belongs; and in a computer generating the metadata of an image using the 2 bits of metadata corresponding to the perceptual color temperature browsing mode to which the color temperature of an image belongs and the 6 bits of metadata corresponding to the color temperature sub-section to which the color temperature of an image belongs.

10. A computer-readable recording medium, on which programs for realizing the method shown in claim 9 in a computer are recorded.

* * * * *